United States Patent [19]

Watanabe et al.

[11] 4,365,857

[45] Dec. 28, 1982

[54] CONNECTOR HAVING POLARITY

[75] Inventors: Kouji Watanabe, Yokohama; Hiroshi Tokudome, Kawasaki, both of Japan

[73] Assignee: Fujitsu Limited, Kawasaki, Japan

[21] Appl. No.: 182,669

[22] Filed: Aug. 29, 1980

[30] Foreign Application Priority Data

Aug. 31, 1979 [JP] Japan ..... 54-110213

[51] Int. Cl.[3] ..... H01R 13/645

[52] U.S. Cl. ..... 339/17 C; 339/176 MP; 339/186 M

[58] Field of Search ..... 339/176 MP, 184 R, 184 M, 339/186 R, 186 M, 17 C

[56] References Cited

U.S. PATENT DOCUMENTS

| | | | |
|---|---|---|---|
| 3,576,519 | 4/1971 | Jayne et al. | 339/186 M |
| 3,675,185 | 7/1972 | Ruehlemann et al. | 339/186 M |
| 3,731,259 | 5/1973 | Occhipinti | 339/186 M |
| 4,159,862 | 7/1979 | Funck et al. | 339/186 M |

FOREIGN PATENT DOCUMENTS

| | | | |
|---|---|---|---|
| 2532885 | 12/1976 | Fed. Rep. of Germany | 339/186 R |
| 586962 | 4/1977 | Switzerland | 339/186 R |

OTHER PUBLICATIONS

Berg PV Connector Systems, Bulletins 1000, 1012, 1013.

*Primary Examiner*—John McQuade
*Attorney, Agent, or Firm*—Staas & Halsey

[57] ABSTRACT

A connector having polarity which comprises a plug and a jack. At least one polar key is provided on the plug so as to avoid erroneous insertion of the jack into the plug. A guide groove is provided on the jack at a position corresponding to the polar key in a normal position of this jack with respect to the plug. A projection is formed on the top end of the polar key and extends in the direction of insertion or withdrawal of the jack. A recess for receiving the projection is formed in the front surface of the jack at a position corresponding to the polar key in a reversed position of the jack with respect to the plug.

14 Claims, 9 Drawing Figures

CONNECTOR HAVING POLARITY

BACKGROUND OF THE INVENTION

The present invention relates to a connector comprising a plug and a jack. More particularly, the invention relates to an improved connector having polarity for preventing a connection when the plug or the jack is reversed.

In a connector having polarity, a polar key projects from an inner side wall of a plug. A guide groove is formed on a side wall of a jack at a position corresponding to said polar key. In such a construction, the jack can be connected to the plug when it is in a normal position, by inserting the polar key into the guide groove. On the other hand, the jack is prevented from being inserted when said jack is in a reversed position, i.e. when it is turned to a position at an angle of 180° from the normal position, in an inlet front surface of the jack, since the polar key of the plug abuts against the front surface of the jack. In a prior art connector having polarity, the top end of the polar key is rounded in order to achieve a smooth insertion of the polar key into the guide groove. Therefore, even when the jack is in the reversed position, said jack can be forced to penetrate into the plug, pushing the side wall thereof open, by an excessive force for insertion. In such a case, the desired function of the polar key, which is to prevent erroneous connection of the jack and the plug, cannot be achieved.

SUMMARY OF THE INVENTION

The present invention was made considering the above point. An object of the present invention is to provide a connector having polarity which reliably prevents the connection of a jack and a plug in an erroneous position relative to each other. In a connector having polarity according to the present invention, a projection is formed on the top end of the polar key of one connector element, and a recess is formed in a front surface of the other connector element. If said elements are in an erroneous position relative to each other, the projection of one element is received by the recess of the other element, so that a connection in an erroneous position is prevented.

DETAILED DESCRIPTION OF THE PREFERRED EMBODIMENTS

Figure 1:
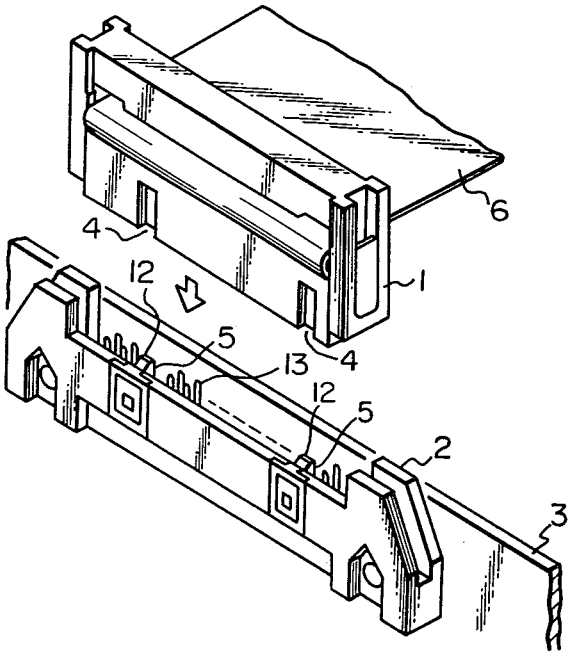
FIG. 1 is a perspective view of an embodiment of a connector with polarity according to the present invention.
Figure 3:
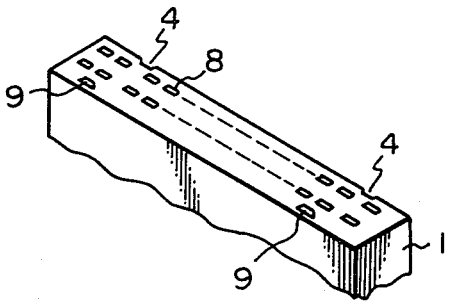
FIG. 3 is a perspective view of a front surface of a jack of a connector according to the present invention.

An embodiment of a connector with polarity according to the present invention is illustrated in FIG. 1. A plug 2 having a number of pin contacts 13 is mounted on an edge of a printed board 3. A jack 1 is inserted into the plug 2 as illustrated by an arrow. The jack 1 has a number of jack holes 8 (FIG. 3) corresponding to the pin contacts 13. Reference numeral 6 designates a flat cable. Two polar keys 5 are provided on an inside side wall surface. Two guide grooves 4 are formed on a side wall of the jack 1 at positions to mate with the corresponding polar keys 5. A projection 12 is formed on the top end of each polar key 5. The projection 12 extends upward, i.e., in the direction of insertion or withdrawal of the jack 1. A recess 9 (FIG. 3) is formed on a front surface of the jack 1 at a position corresponding to each of the projections 12 when the jack 1 is reversed, in order to prevent connection of the connector.

Figure 4:
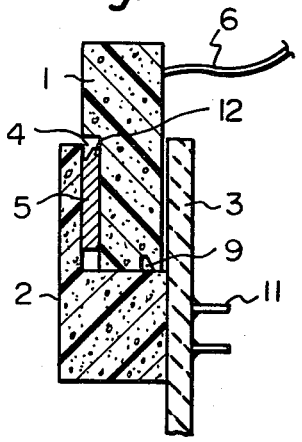
FIG. 4 is a sectional view of a connector with polarity according to the present invention, when the jack is in a normal position.
Figure 5:
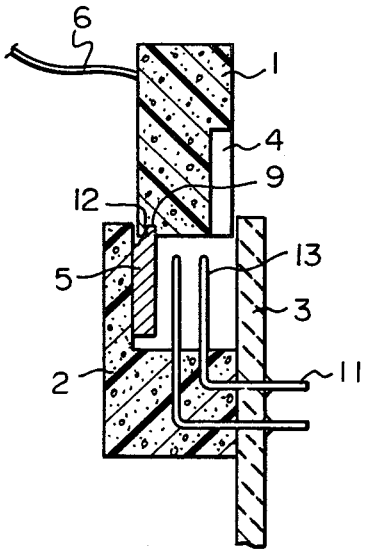
FIG. 5 is a sectional view of a connector with polarity according to the present invention, when the jack is in a reverse position.

As illustrated in FIG. 4, in operation of the connector with polarity according to the present invention, when the jack 1 is in the normal position relative to the plug 2, the polar key 5 of the plug 2 is fitted into the guide groove 4 of the jack 1 so that the connection of the jack 1 and the plug 2 can be achieved. On the other hand, as illustrated in FIG. 5, when the jack 1 is in a reversed position, the projection 12 of the polar key 5 is received by the recess 9 of the jack 1, so that the jack 1 cannot be inserted into the plug 2. Even if excess force is exerted upon the jack 1, the jack 1 never pushes the side wall of the plug 2 open and thus never penetrates into the plug 2, as was the case in the prior art. Therefore, the erroneous insertion of the jack in the reversed position into the plug can be consistently avoided.

As mentioned above, the present invention is very advantageous in actual use, since the erroneous connection can be reliably avoided and the construction of the device of the present invention is simple.

Figure 2:
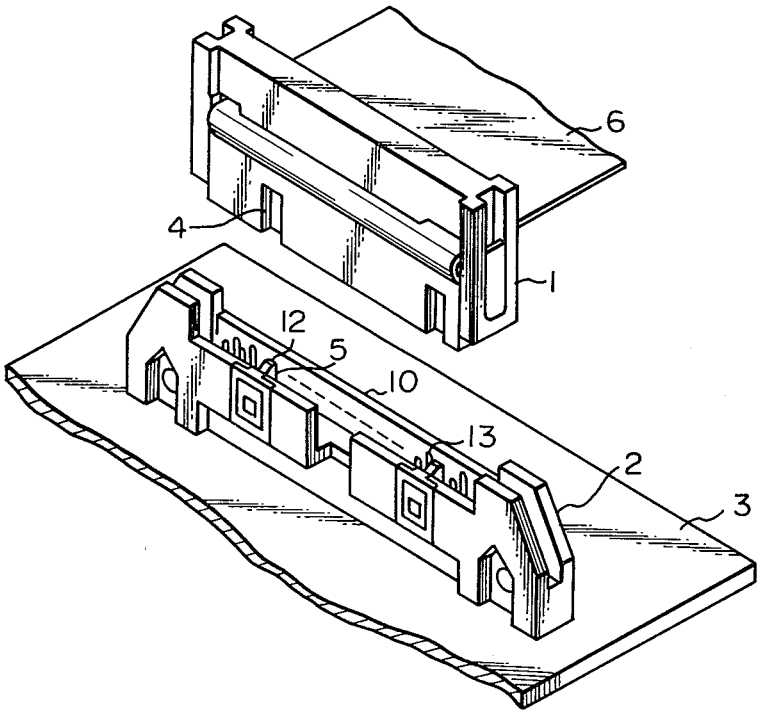
FIG. 2 is a perspective view of another embodiment of the present invention.

In the above mentioned embodiment of FIGS. 1, 3, 4 and 5, the connector is a right angle type connector, wherein the pin contacts 13 are perpendicular to terminals 11. In such a right angle type connection, the jack 1 is guided through the space between the printed board 3 and the side wall of the plug 2 provided with the polar key 5. On the other hand, as illustrated in FIG. 2, in a case of a straight type connector, the pin contacts 13 and the terminal 11 (not shown) are disposed in straight lines. The plug 2 of the straight type connector is perpendicularly mounted to and on the printed board 3. In the connector of FIG. 2, a side wall 10 is provided so as to guide the jack 1 along the plug 2 so that the jack holes 8 (FIG. 3) of the jack 1 correctly receive the pin contacts 13 of the plug 2. Due to the side wall 10, the jack 1 is prevented from shifting away from the other side wall having the polar keys 5 at the time of connection of the jack 1 and the plug 2. Therefore, the function and effect of the polar keys are achieved so that an erroneous insertion of the jack 1 into the plug 2 can be reliably avoided.

Figure 6:
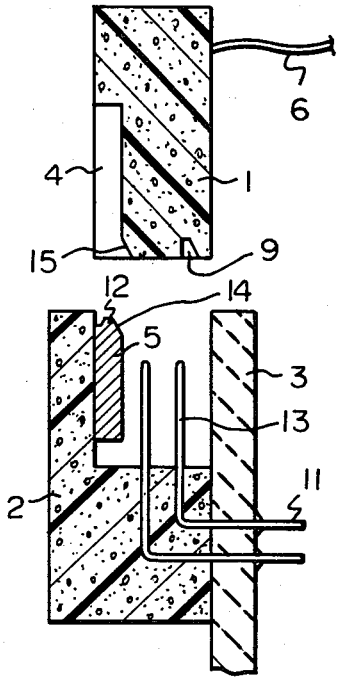
FIG. 6 is a sectional view of another embodiment of a connector with polarity according to the present invention.

As illustrated in FIG. 6, the projection 12 of the polar key 5 may have an inclined surface 14. Also, the guide groove 4 may have an inclined surface 15 on the inside wall at its bottom end. By such an arrangement, the polar key 5 can be smoothly inserted into the guide groove 4. Only one of the inclined surfaces 14 and 15 may be formed on the polar key 5 or guide groove 4.

Figure 7:
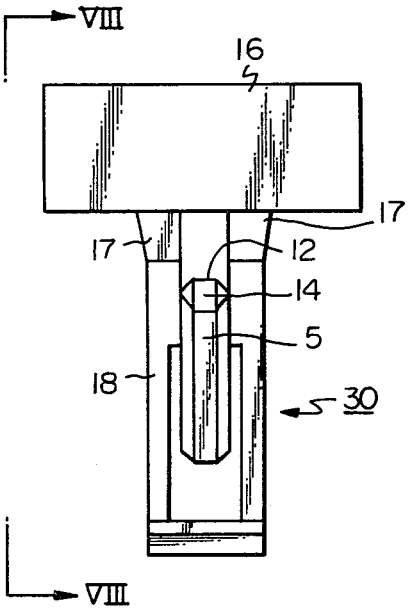
FIG. 7 is a front view of a polar key element according to the present invention.
Figure 8:
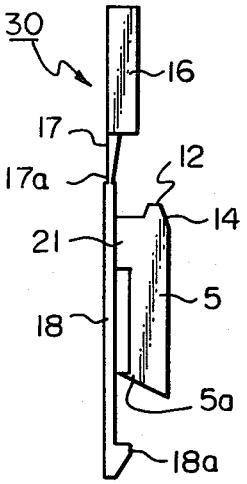
FIG. 8 is a side view of a polar key element according to the present invention.
Figure 9:
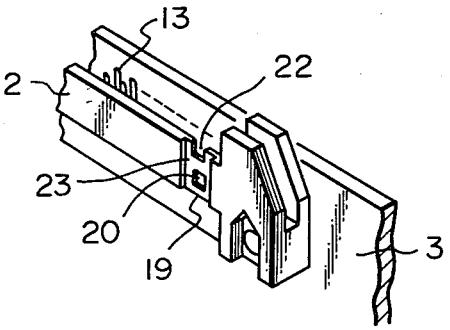
FIG. 9 is a partial perspective view of a plug without provision of the polar key according to the present invention.

The polar key 5 of the present invention may be formed as a polar key element 30 which is illustrated in FIGS. 7 and 8, by moulding plastic materials or resins, etc. The polar key element 30 comprises a handle plate 16, a frame 18 connected to the handle plate 16 by two connecting bridges 17, and, the polar key 5 supported on the frame 18 through a support portion 21. A thin portion 17*a* is formed at the lower end of each connecting bridge 17 so that the handle plate 16 can be easily separated from the frame 18. The projection 12 has a shape of a truncated pyramid. The polar key 5 has a hook 5*a* on its lower end. The frame 18 has a hook 18*a* on its lower end. Such a polar key element 30 is installed onto the side wall of the plug 2 along a groove 23 (FIG. 9) formed thereon. When the polar key element 30 is installed, the hook 18*a* of the frame 18 engages a step 19 formed on the lower end of the groove 23. Also, the hook 5*a* of the polar key 5 engages a hole 20 formed in the bottom surface of the groove 23. By the engagement of hooks 5*a* and 18*a* with the hole 20 and the step 19, respectively, the polar key element 30 is secured to the side wall of the plug 2. Then, the handle plate 16 is removed by separating it from the frame 18 along the thin portion 17*a* of each connecting bridge 17. Such a polar key 5 installed in the form of a polar key element 30 can be easily removed. Therefore, by removing the polar key 5 from the plug 2, a jack without the guide groove 4 can be connected to this plug.

The ploar key 5 may be formed integrally with the plug 2 instead of being separately formed as the polar key element 30.

We claim:

1. A connector having polarity comprising:

a jack;

a plug having a side wall; and at least one polar key element, wherein said polar key element has a handle plate, a frame, two connecting bridges which connect said handle plate and said frame, a thin portion formed on each of said bridges near the connecting portion with said frame, a bar-like polar key supported on said frame adjacent to the space between said two bridges, and a projection which is formed on the upper end of said bar-like polar key and projects upward therefrom; and wherein the side wall of said plug is inserted between said bar-like polar key and said frame for positioning said polar key element thereon.

2. The connector of claim 1, wherein the side wall of said plug has a groove formed thereon and said polar key element is positioned on said plug side wall along said groove.

3. The connector of claim 2, further comprising a hook formed at the lower end of said bar-like polar key and wherein said groove of said plug side wall has a hole formed in the bottom surface thereof for receiving said polar key hook when said polar key element is positioned on said plug side wall.

4. The connector of claim 3, further comprising a hook formed at the lower end of said frame and wherein said groove of said plug side wall has a step formed at the lower end thereof for engaging said frame hook when said polar key element is positioned on said plug side wall.

5. The connector of claims 1, 2, 3, or 4, wherein said handle plate is removable from said polar key element after insertion of said key element in said plug by separation from said frame along the thin portion of each connecting bridge.

6. The connector of claims 1, 2, 3, or 4, wherein said jack has at least one guide groove on a side surface thereof into which groove said bar-like polar key can be inserted when said plug is in a normal position, and said jack further having at least one recess in a front surface thereof at a position corresponding to said bar-like polar key when said plug is in a reversed position relative to said jack.

7. A connector having polarity according to claim 6, wherein said projection has an inclined surface for smooth insertion of said polar key into said guide groove.

8. A connector having polarity according to claim 6, wherein said guide groove has an inclined surface at an inlet thereof for smooth insertion of said polar key into said guide groove.

9. A connector having polarity according to claim 7, wherein said guide groove has an inclined surface at an inlet thereof for smooth insertion of said polar key into said guide groove.

10. A connector having polarity according to claim 6, wherein the plug is mounted on a printed board so that the direction of insertion or withdrawal of the jack is parallel to said printed board surface.

11. A connector having polarity according to claim 6, wherein the plug is mounted on a printed board so that the direction of insertion or withdrawal of the jack is perpendicular to said printed board surface.

12. A moulded polar key element comprising: a handle plate; a frame; two connecting bridges which connect said handle plate and said frame; a thin portion formed on each of said bridges near the connecting portion with said frame; a bar like polar key supported on said frame at a position adjacent to the space between said two bridges, and; a projection which is formed on the upper end of said polar key and projects upward therefrom.

13. The molded polar key element of claim 12, further comprising a hook formed at the lower end of said frame.

14. The molded polar key element of claim 12 or 13, further comprising a hook formed at the lower end of said bar like polar key.

* * * * *

UNITED STATES PATENT AND TRADEMARK OFFICE

CERTIFICATE OF CORRECTION

PATENT NO. : 4,365,857

DATED : December 28, 1982

INVENTOR(S) : Watanabe et al.

It is certified that error appears in the above-identified patent and that said Letters Patent is hereby corrected as shown below:

Title page, [57] ABSTRACT, line 11, "reversed" should be --reverse--.

Signed and Sealed this

*Twenty-second* Day of *March 1983*

[SEAL]

*Attest:*

GERALD J. MOSSINGHOFF

*Attesting Officer*

*Commissioner of Patents and Trademarks*